US008104887B2

(12) United States Patent
Albrecht et al.

(10) Patent No.: US 8,104,887 B2
(45) Date of Patent: Jan. 31, 2012

(54) METHOD FOR IMPRINTING A THREE-DIMENSIONAL ARTICLE

(75) Inventors: Ludwig Albrecht, Dornstetten-Aach (DE); Karl Frey, Schopfloch (DE)

(73) Assignee: Homag Holzbearbeitungssysteme AG (DE)

( * ) Notice: Subject to any disclaimer, the term of this patent is extended or adjusted under 35 U.S.C. 154(b) by 71 days.

(21) Appl. No.: 12/055,904

(22) Filed: Mar. 26, 2008

(65) Prior Publication Data

US 2008/0239048 A1 Oct. 2, 2008

(30) Foreign Application Priority Data

Mar. 27, 2007 (EP) ..... 07006247

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS

| | | | | |
|---|---|---|---|---|
| 3,659,522 | A * | 5/1972 | Dubuit | 101/35 |
| 3,811,915 | A | 5/1974 | Burrell et al. | |
| 3,975,740 | A | 8/1976 | Distler | |
| 4,017,869 | A | 4/1977 | Meyer | |
| 4,215,350 | A | 7/1980 | Mielke et al. | |
| 4,378,564 | A | 3/1983 | Cross et al. | |
| 4,514,742 | A | 4/1985 | Suga et al. | |
| 4,720,301 | A | 1/1988 | Kito et al. | |
| 4,814,795 | A | 3/1989 | Kuester et al. | |
| 5,113,757 | A | 5/1992 | Spencer | |
| 5,133,822 | A | 7/1992 | Fujii et al. | |
| 5,581,284 | A | 12/1996 | Hermanson | |
| 5,810,487 | A * | 9/1998 | Kano et al. | 347/4 |
| 5,830,529 | A | 11/1998 | Ross | |
| 5,869,138 | A | 2/1999 | Nishibori | |
| 5,931,098 | A | 8/1999 | Bates | |
| 5,935,331 | A | 8/1999 | Naka et al. | |
| 5,986,680 | A | 11/1999 | Wen et al. | |
| 6,053,231 | A | 4/2000 | Matsuguchi | |
| 6,072,509 | A | 6/2000 | Wen et al. | |
| 6,174,052 | B1 | 1/2001 | Eremity et al. | |
| 6,286,920 | B1 | 9/2001 | Ridgway | |

(Continued)

FOREIGN PATENT DOCUMENTS

CA 2492712 12/2004

(Continued)

OTHER PUBLICATIONS

U.S. Appl. No. 11/844,607, Dec. 2, 2010—Response to Non-Final Office Action.

(Continued)

*Primary Examiner* — Shelby Fidler
(74) *Attorney, Agent, or Firm* — Baker Botts L.L.P.

(57) ABSTRACT

The invention relates to a method for imprinting a three-dimensional article, in particular a container and/or workpiece, and comprises utilizing a printing means, in particular an ink-jet printing means, for imprinting a surface of the three-dimensional article, and a conveyor means for bringing about a relative movement between the printing means and the three-dimensional article to be imprinted. The method according to the invention is characterised in that it further utilizes a positioning means which is configured to bring the surface to be imprinted of the three-dimensional article into a predetermined relative relationship to, in particular a predetermined distance from, the printing means.

3 Claims, 3 Drawing Sheets

U.S. PATENT DOCUMENTS

| | | | | |
|---|---|---|---|---|
| 6,358,220 | B1 | 3/2002 | Langen et al. | |
| 6,465,046 | B1 | 10/2002 | Hansson | |
| 6,634,729 | B1 | 10/2003 | Schuman et al. | |
| 6,635,142 | B1 | 10/2003 | Stula et al. | |
| 6,694,872 | B1 | 2/2004 | LaBelle et al. | |
| 6,789,876 | B2 | 9/2004 | Barclay et al. | |
| 6,894,709 | B2 | 5/2005 | Pferrer | |
| 7,357,959 | B2 | 4/2008 | Bauer | |
| 7,691,294 | B2 | 4/2010 | Chung et al. | |
| 7,762,647 | B2 | 7/2010 | Mehta et al. | |
| 2001/0003871 | A1 | 6/2001 | Patton et al. | |
| 2001/0005942 | A1 | 7/2001 | Patton et al. | |
| 2001/0049010 | A1 | 12/2001 | Fenzi | |
| 2002/0024577 | A1* | 2/2002 | Takeya et al. | 347/107 |
| 2002/0033851 | A1 | 3/2002 | Waldner et al. | |
| 2002/0033865 | A1 | 3/2002 | Ishinaga et al. | |
| 2002/0061389 | A1 | 5/2002 | Brooker et al. | |
| 2002/0189754 | A1 | 12/2002 | Hill | |
| 2003/0020767 | A1 | 1/2003 | Saksa | |
| 2003/0029938 | A1 | 2/2003 | Vogel | |
| 2003/0043246 | A1 | 3/2003 | Codos | |
| 2003/0048343 | A1 | 3/2003 | Anderson | |
| 2003/0211251 | A1 | 11/2003 | Daniels | |
| 2003/0217807 | A1 | 11/2003 | Lesmann et al. | |
| 2003/0218650 | A1 | 11/2003 | Valero | |
| 2003/0218663 | A1 | 11/2003 | Baxter et al. | |
| 2004/0026017 | A1 | 2/2004 | Taylor et al. | |
| 2004/0028830 | A1 | 2/2004 | Bauer | |
| 2004/0094426 | A1 | 5/2004 | Lai | |
| 2004/0141764 | A1 | 7/2004 | Runkowske et al. | |
| 2004/0250947 | A1 | 12/2004 | Phillips et al. | |
| 2004/0257398 | A1 | 12/2004 | Otsuki | |
| 2004/0263544 | A1 | 12/2004 | Kojima | |
| 2005/0017995 | A1 | 1/2005 | Pferrer | |
| 2005/0034960 | A1 | 2/2005 | Shimamura et al. | |
| 2005/0151820 | A1 | 7/2005 | Sirringhaus et al. | |
| 2005/0204593 | A1 | 9/2005 | Bilger et al. | |
| 2005/0274272 | A1 | 12/2005 | Machesky | |
| 2005/0279450 | A1 | 12/2005 | King | |
| 2006/0021535 | A1 | 2/2006 | Kaiser | |
| 2006/0023018 | A1 | 2/2006 | Hatayama | |
| 2006/0046326 | A1 | 3/2006 | Kok et al. | |
| 2006/0075917 | A1 | 4/2006 | Edwards | |
| 2006/0162650 | A1 | 7/2006 | Kido et al. | |
| 2008/0092923 | A1 | 8/2006 | Rettenmyer et al. | |
| 2006/0228150 | A1 | 10/2006 | Hosokawa | |
| 2006/0275590 | A1 | 12/2006 | Lorenz et al. | |
| 2007/0044324 | A1 | 3/2007 | Harris | |
| 2007/0064030 | A1 | 3/2007 | Abergel et al. | |
| 2007/0091132 | A1 | 4/2007 | Lim | |
| 2007/0263043 | A1* | 11/2007 | Bradford et al. | 347/84 |
| 2008/0151006 | A1 | 6/2008 | Nishio et al. | |
| 2008/0152819 | A1 | 6/2008 | Gauss et al. | |
| 2008/0267828 | A1 | 10/2008 | Wang et al. | |
| 2008/0277630 | A1 | 11/2008 | Kiyoshima et al. | |
| 2009/0252933 | A1 | 10/2009 | Free et al. | |
| 2010/0098887 | A1 | 4/2010 | Matsuishi et al. | |

FOREIGN PATENT DOCUMENTS

| | | | |
|---|---|---|---|
| CN | 1681656 | | 10/2005 |
| DE | 19532724 | A1 | 3/1998 |
| DE | 19823195 | | 11/1999 |
| DE | 199 55 575 | | 5/2001 |
| DE | 202004000662 | U1 | 4/2004 |
| DE | 10 2005 020119 | B3 | 4/2005 |
| DE | 103 42 723 | | 8/2005 |
| DE | 202006000270 | U | 4/2006 |
| DE | 10 2006 056 010 | | 7/2007 |
| EP | 0095046 | | 11/1983 |
| EP | 0494363 | | 7/1992 |
| EP | 0993903 | | 4/2000 |
| EP | 1225053 | | 7/2002 |
| EP | 1435296 | | 7/2004 |
| EP | 1479524 | | 11/2004 |
| EP | 1714884 | A | 4/2005 |
| EP | 1726443 | A | 4/2005 |
| EP | 1800813 | | 6/2007 |
| FR | 2601265 | | 1/1988 |
| GB | 722 485 | A | 9/1953 |
| GB | 2 335 885 | A | 3/1998 |
| JP | 2006164 | | 1/1990 |
| JP | 10 157245 | A | 11/1996 |
| JP | 09226226 | | 9/1997 |
| JP | 10226045 | | 8/1998 |
| WO | WO0148333 | | 7/2001 |
| WO | WO2004016438 | | 2/2004 |
| WO | WO2005009735 | | 2/2005 |

OTHER PUBLICATIONS

U.S. Appl. No. 11/765,196, Dec. 16, 2010—Response to Final Office Action.
U.S. Appl. No. 11/632,461, Dec. 21, 2010—Non-Final Office Action.
U.S. Appl. No. 11/940,135, Jan. 4, 2011—Response to Final Office Action.
U.S. Appl. No. 11/765,196, Jan. 18, 2011—Non-Final Office Action.
U.S. Appl. No. 11/940,135, Jan. 19, 2011—Advisory Action.
U.S. Appl. No. 11/632,461, filed Oct. 22, 2007.
U.S. Appl. No. 11/765,196, filed Jun. 19, 2007.
U.S. Appl. No. 11/844,607, filed Aug. 24, 2007.
U.S. Appl. No. 11/935,924, filed Nov. 6, 2007.
U.S. Appl. No. 11/940,135, filed Nov. 14, 2007.
U.S. Appl. No. 12/118,389, filed May 9, 2008.
U.S. Appl. No. 11/765,196, Apr. 1, 2010 Non-Final Office Action.
U.S. Appl. No. 11/765,196, Jul. 2, 2010 Response to Non-Final Office Action.
U.S. Appl. No. 11/935,924, Feb. 23, 2010 Non-Final Office Action.
U.S. Appl. No. 11/935,924, May 24, 2010 Response to Non-Final Office Action.
U.S. Appl. No. 11/935,924, Jun. 28, 2010 Notice of Allowance & Examiner's Amendment.
U.S. Appl. No. 11/940,135, Apr. 5, 2010 Non-Final Office Action.
U.S. Appl. No. 11/940,135, Aug. 5, 2010 Response to Non-Final Office Action.
U.S. Appl. No. 11/844,607, Sep. 2, 2010 Non-Final Office Action.
U.S. Appl. No. 11/765,196, Sep. 22, 2010 Final Office Action.
U.S. Appl. No. 11/940,135, Oct. 4, 2010 Final Office Action.
European Search Report issued in EP07006247.6 on May 22, 2007.
U.S. Appl. No. 11/765,196, May 17, 2011 Response to Non-Final Office Action.
U.S. Appl. No. 11/765,196, Jun. 30, 2011 Final Office Action.
U.S. Appl. No. 11/632,461, Jun. 15, 2011 Final Office Action.
U.S. Appl. No. 11/844,607, May 4, 2011 Amendment and Request for Continued Examination (RCE).
U.S. Appl. No. 11/844,607, May 25, 2011 Notice of Allowance.
U.S. Appl. No. 11/844,607, Aug. 25, 2011 Issue Fee Payment.
U.S. Appl. No. 11/960,121, Jun. 15, 2011 Response to Non-Final Office Action.
U.S. Appl. No. 11/960,121, Aug. 19, 2011 Final Office Action.
U.S. Appl. No. 12/118,389, Aug. 23, 2011 Response to Non-Final Office Action.
U.S. Appl. No. 11/844,607, Feb. 4, 2011 Final Office Action.
U.S. Appl. No. 11/960,121, Feb. 18, 2011 Non-Final Office Action.
U.S. Appl. No. 11/940,135, Mar. 21, 2011 Non-Final Office Action.
U.S. Appl. No. 11/940,135, Mar. 4, 2011 Supplemental Response to Final Office Action.
U.S. Appl. No. 11/632,461, Mar. 21, 2011 Response to Non-Final Office Action.
U.S. Appl. No. 12/118,389, May 23, 2011 Non-Final Office Action.
Summary of ISO 2817 and 2813, International Organization for Standard, (no date available).
"Numerical Investigation of Droplet Impact Spreading in Spray Coating of Paper", Advanced Coating Fundamentals Symposium, (Spring 2003).

* cited by examiner

METHOD FOR IMPRINTING A THREE-DIMENSIONAL ARTICLE

CROSS-REFERENCE TO RELATED APPLICATIONS

The present application claims the benefit of EP Application No. 07 006247.6, filed Mar. 27, 2007, which is hereby incorporated by reference in its entirety.

TECHNICAL FIELD

The invention relates to a device for imprinting a three-dimensional article, in particular a container and/or workpiece, according to the preamble of claim 1.

PRIOR ART

Three-dimensional articles, such as for example plate-like workpieces from the field of the furniture industry, are increasingly being imprinted with various patterns which are desired by the customers, for example by means of an ink-jet printing device. Thus, for example, EP 1 726 443 A discloses a generic device for imprinting workpieces in the region of a narrow face, with which high-quality patterns can be produced. However, it has been found that the desired quality of the printed image cannot be achieved in some cases, for example in deformable or non-uniform workpieces.

PRESENTATION OF THE INVENTION

It is therefore the object of the invention to provide a device of the type mentioned at the outset that allows high-quality patterning of articles even in the case of deformable or non-uniform three-dimensional articles.

According to the invention, this object is achieved by a device for imprinting a three-dimensional article according to claim 1. Particularly advantageous developments of the invention are disclosed in the dependent claims.

The invention is based on the finding that, in a device of the type mentioned at the outset, the quality of the pattern is substantially dependent on the distance between the printing means and the surface to be patterned of the article. For this purpose, the invention provides for the device further to have a positioning means which is configured to bring the surface to be imprinted of the three-dimensional article into a predetermined relative relationship to, in particular a predetermined distance from, the printing means. In this way, it is possible to ensure, even in the case of deformable or non-uniform three-dimensional articles, at all times an optimum distance between the printing means and the surface to be patterned of the article, thus allowing high-quality patterning to be achieved.

At the same time, this results in a simple operation and a simple design of the device according to the invention, as precise application of the article to be imprinted or positional detection by means of sensors or the like is not imperative.

Within the scope of the present invention, the positioning means can be configured in a broad range of ways. A development of the invention provides for the positioning means to have at least one stop element, thus allowing effective relative positioning to be achieved with a simple design. However, it should be noted that the present invention also allows for the use of positioning means which operate in a contactless manner and can operate, for example, magnetically or otherwise.

Alternatively or additionally, the positioning means has according to a development of the present invention at least one endlessly revolving or rotating stop element, in particular a guide belt or a stop roll. Stop elements of this type combine precise positioning with low-friction and prompt conveyance of the articles to be imprinted in the device.

In all of the configurations of the positioning means, it is preferable, within the context of the present invention according to a development, for the positioning means to be disposed, in relation to the relative movement between the printing means and the three-dimensional article to be imprinted, upstream of the printing means at least in certain portions. This allows the surface to be imprinted to be brought particularly effectively into the desired position relative to the printing means, thus producing a high print quality.

According to a development of the invention, the positioning means has at least two stop elements. This results in a particularly precise definition of the relative positioning between the surface to be imprinted and the printing means. It is in this regard particularly preferable for at least one stop element to be movable. Various advantages can be achieved in this way. On the one hand, the movability of at least one stop element allows the device to be adapted to different dimensions of the articles to be imprinted; on the other hand, the movability of at least one stop element can also be utilised to generate a contact force between the stop elements and the surfaces to be imprinted in order as a result to guide the articles in a particularly stable manner and further to improve the print quality.

Within the context of the present invention, the printing means can be configured in a broad range of ways and have, for example, also a plurality of printing units in order to imprint the respective article not only on one surface but rather on a plurality or, if appropriate, all of the surfaces. It is in this regard particularly preferable for at least one stop element to be associated with each printing unit, thus allowing the precise relative positioning according to the invention to be achieved for each printing unit, although the device according to the invention can also have printing units without a stop element.

It is in this regard particularly preferable for at least one printing unit to be movable, preferably synchronously with the at least one associated stop element. This allows the device to be adapted in a simple and precise manner to a broad range of dimensions and configurations of articles to be imprinted without an associated loss in print quality.

The device according to the invention is particularly suitable for imprinting containers. A corresponding method according to the invention forms the subject-matter of claim 8. This method is distinguished in that the container is imprinted in a condition in which it is ready to receive contents, in particular workpieces. This gives rise primarily to two main advantages. Firstly, the imprinting of a container which is ready to be received allows the container to be imprinted at a very late moment in the value creation chain, so a large number of container preforms (for example cardboard blanks) does not have to be printed long in advance; on the contrary, a corresponding overprint is, for example, applied just before the containers are filled. In addition, the method according to the invention ensures that the applied pattern is not impaired (for example scratched) by subsequent processing steps for manufacturing the container (for example processes of folding a cardboard blank). Overall, the method according to the invention thus allows high-quality and variable imprinting (which can be adapted to changing container contents) of the containers.

A development of the method according to the invention provides for, prior to imprinting, the container to be filled with contents, in particular workpieces. This opens up quite new possibilities for individualising containers. It is thus, for example, possible to fill containers with respective contents in large-scale production and, if appropriate, to seal them from the outset and to retrieve the filled containers only once a corresponding customer order has been placed and to provide them with the pattern which is desired by the customer and shows, for example, the customer's logo, etc. This prevents any wastage of containers which in the past resulted from imprinted container preforms being preproduced in large volumes without a corresponding customer order having been placed or sufficiently specified. Overall, this allows extremely variable and customer-individualised imprinting of containers with low wastage while the imprinting quality remains high.

In addition, a development of the method according to the invention provides for, prior to imprinting, the surface to be imprinted of the container being deformed by the positioning means. This allows curved surfaces of the container to be brought, prior to imprinting, into a flat state which is particularly suitable for high-quality imprinting. This can be advantageous, for example, in containers filled with workpieces, as it has been found that the process of filling the container in some cases produces undesirable deformation of the container, which can impair the printing process.

DETAILED DESCRIPTION OF PREFERRED EMBODIMENTS

Preferred embodiments of the present invention will be described hereinafter in detail with reference to the accompanying drawings.

Figure 1:
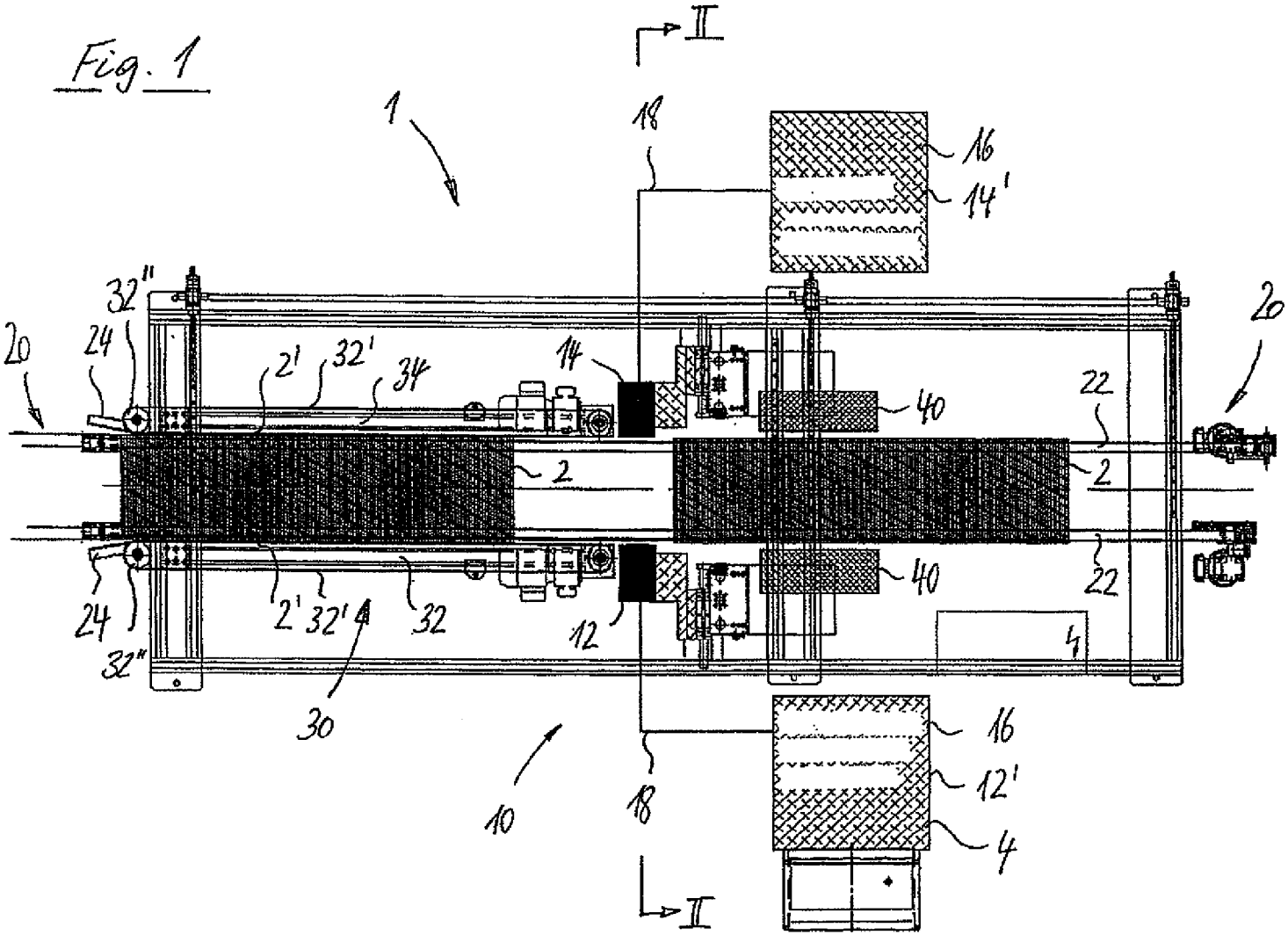
FIG. 1 is a schematic plan view of a device for imprinting containers according to an embodiment of the invention.
Figure 2:
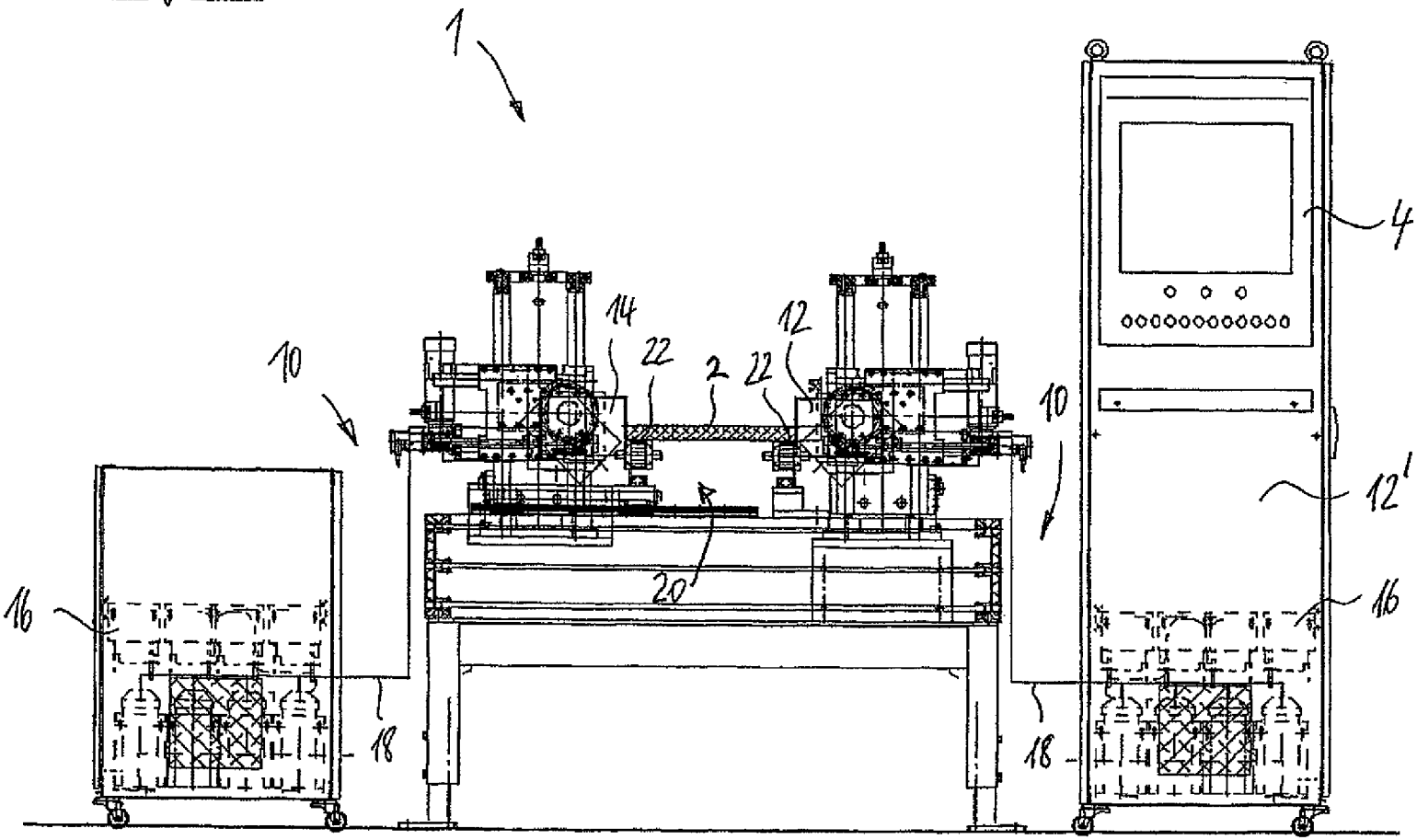
FIG. 2 is a schematic sectional view of the device shown in FIG. 1, the section being guided in FIG. 1 along line II-II.
Figure 3:
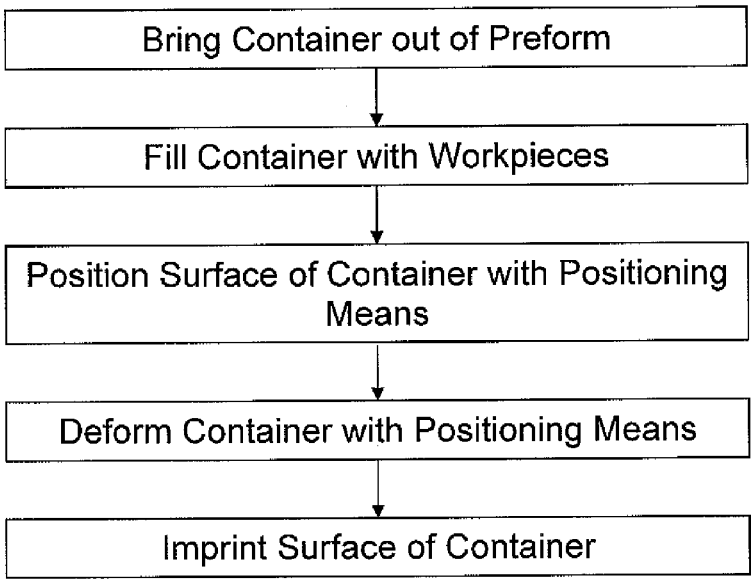
FIG. 3 illustrates an overview of a method for imprinting a three-dimensional article in accordance with an embodiment of the invention.

FIG. 1 is a schematic plan view and FIG. 2 a schematic sectional view of a device 1 for imprinting containers 2. The container 2 is in the present embodiment a cardboard comprising a filling opening which is located on top and was folded beforehand out of a cardboard blank. It should however be noted that the present invention is also applicable to completely different types of containers and also to completely different types of three-dimensional articles such as, for example, plate or strip-like workpieces such as are used in the field of the furniture industry and can often be made of wood, wood materials, plastics materials, etc. or combinations thereof.

The device 1 has in the present embodiment a printing means 10 comprising two printing units 12, 14 which are configured in the present embodiment as ink-jet print heads comprising a plurality of ink outlets. The printing units 12, 14 are each connected to an ink supply container 16 via a feed line 18, although the ink supply container 16 can obviously also be disposed directly on the print head 12, 14.

Furthermore, the printing units 12, 14 are each connected to a printer controller 12', 14', wherein the present invention also provides for an individual, integrated printer controller which, if appropriate, can also control the device as a whole. It should also be borne in mind that the present invention also allows any other types of printing means to be used.

In addition, the device 1 comprises a conveyor means 20 in order to convey the articles 2 to be imprinted along the printing units 12, 14. In this regard, the conveyor means 20 is in the present embodiment configured as a belt conveyor comprising two conveyor belts 22, although obviously use may also be made of any other conveyor means such as chain conveyors, carriage conveyors, air-cushion conveyors and the like.

In addition, it should be noted that the conveyor means can also be configured in such a way that, alternatively or additionally to conveyance of the article to be imprinted, the printing means is moved. The present invention may thus relate both to continuously operating machines and to stationary machines and also to combinations thereof such as, for example, machines which operate in a clocked manner.

Furthermore, the device 1 according to the invention comprises a positioning means 30 which in the present embodiment is formed by two lateral guide belts 32, 34. In this regard, the guide face of the guide belts 32, 34 extends substantially perpendicularly to the plane of conveyance of the conveyor means 20. Expressed more generally, the guide face of the guide belts 32, 34 or general stop elements extends substantially parallel to a printing output face (for example a face comprising nozzle outlets) of the associated printing unit 12 or 14.

The guide belts 32, 34 are, as may be seen most clearly in FIG. 1, formed by endlessly revolving belts 32' which are respectively tensioned about two deflection rolls 32" and are optionally guided therebetween via a guide rail. Alternatively or additionally to the guide belts 32, 34 shown, the positioning means used can obviously also be other types of stop elements such as, for example, stop rolls, stop plates, stop bolts or the like.

The guide belts 32, 34 are disposed, in relation to the direction of conveyance of the articles 2 to be imprinted, upstream of the printing units 12, 14. In this regard, the guide belts 32, 34 can be adjusted in such a way that their guide face facing the articles 2 to be imprinted is at a predetermined (orthogonal) distance from the ink outlets in the print heads 12, 14.

Of the two guide belts 32, 34, in the present embodiment the guide belt 34 is movable, thus allowing the distance between the guide belts 32, 34 to be varied in accordance with the respective width of the articles 2 to be imprinted. In this regard, the printing unit 14 is also movable in conjunction with or simultaneously to the guide belt 34 in order at all times to ensure the desired or optimum (orthogonal) distance between the ink outlets in the print head 14 and the surface 2' to be imprinted of the respective article 2.

Disposed at the upstream end of the guide belts 32, 34 are, in addition, funnel-like run-in elements 24 which help to introduce the articles conveyed by the conveyor means 20 securely into the region between the guide belts 32, 34.

The operation of the conveyor means 20 and of the positioning means 30 is in the present embodiment controlled by a machine controller 4, although the machine controller may, as indicated hereinbefore, optionally also be combined with the printer controller 12', 14' to form an integral control unit. In this regard, the speed of conveyance of the conveyor means 20 is advantageously adapted to the speed of conveyance of the guide belts 32, 34.

Disposed downstream of the printing units 12, 14 are, in addition, in the present embodiment two drying means 40 which are configured to dry or to set as promptly as possible the ink applied to the respective articles 2. Although the present invention allows for the use of any desired printing medium or any desired printing ink, it has proven advantageous, in particular in the case of containers 2 which are to be imprinted and are made of cardboard or the like, to use an oil-based ink. This prevents possible problems in the drying or setting of UV ink using a UV drying means, as it has been found that the ink penetrates deep into the cardboard material and then is no longer optimally accessible to a process of drying or setting by the UV rays.

The operation of the device 1 according to the invention is carried out, within an integrated customer dispatch system for example, as follows. In a preceding process, plate-like workpieces such as floor panels or the like are, for example, produced, packaged in cardboard containers 2 and stored temporarily. In this regard, the cardboard containers 2 are, for example, brought in advance into a container form by the folding of cardboard blanks.

As soon as a specific customer order has been placed and the manner in which the customer wishes the containers 2 to be patterned is known, the ordered number of containers 2 is supplied to the device 1 and introduced into the region between the guide belts 32, 34. In this regard, the device 1 upstream of the guide belts can, if appropriate, detect the width of the containers 2 to be imprinted and adjust the position of the guide belt 34, together with the position of the printing unit 14, to the appropriate width. When the containers 2 are conveyed into the region between the guide belts 32, 34, the lateral portions of the containers 2, which as a result of the articles located in the container 2 often protrude laterally, are in the present embodiment deformed and brought into a precisely defined position relative to the nozzle outlets in the printing units 12 and 14. Alternatively, it is possible, especially in the case of dimensionally stable articles such as workpieces, for the articles not to be deformed by the guide belts 32, 34 but rather to be displaced into the desired relative position.

As soon as the container 2 has issued from the region between the guide belts 32, 34, the lateral faces 2' of the container 2 are imprinted using the printing units 12, 14.

Subsequently, the containers 2 pass through the drying means 40 which are used to dry the ink applied by the printing units 12, 14, so the containers 2 filled with workpieces can immediately afterwards continue to be processed, for example can be welded into a transparent film.

The invention claimed is:

1. A method for imprinting a cardboard container having a surface, wherein the method comprises:

(a) moving the container on a conveyor to bring about a relative movement between the container and a printer;

(b) positioning the surface of the container with a positioning means to a predetermined relative relationship to the printer, (c) deforming the surface of the container with the positioning means, and (d) imprinting the surface of the container while the container is in the predetermined relative relationship to the printer:

wherein, prior to imprinting, the container is brought out of a preform, into a container form; and further wherein, prior to imprinting, the container is filled with contents.

2. The method according to claim 1, wherein the preform is a cardboard blank, and the container is folded.

3. The method according to claim 1 wherein the contents are workpieces.

* * * * *